US011879313B2

(12) United States Patent
Wakefield et al.

(10) Patent No.: US 11,879,313 B2
(45) Date of Patent: Jan. 23, 2024

(54) MATERIAL MESH FOR SCREENING FINES

(71) Applicants: John K. Wakefield, Cypress, TX (US); Michael H. Johnson, Katy, TX (US)

(72) Inventors: John K. Wakefield, Cypress, TX (US); Michael H. Johnson, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 390 days.

(21) Appl. No.: 16/936,620

(22) Filed: Jul. 23, 2020

(65) Prior Publication Data

US 2020/0347704 A1 Nov. 5, 2020

Related U.S. Application Data

(62) Division of application No. 15/795,708, filed on Oct. 27, 2017, now Pat. No. 10,767,451.

(60) Provisional application No. 62/504,676, filed on May 11, 2017.

(51) Int. Cl.
*E21B 43/08* (2006.01)
*E21B 43/10* (2006.01)

(52) U.S. Cl.
CPC ..... *E21B 43/084* (2013.01); *E21B 43/088* (2013.01); *E21B 43/10* (2013.01)

(58) Field of Classification Search
CPC ..... E21B 43/08–088; E21B 43/12
See application file for complete search history.

(56) References Cited

U.S. PATENT DOCUMENTS

2006/0175065 A1* 8/2006 Ross ..... E21B 43/082 166/386
2007/0012444 A1* 1/2007 Horgan ..... E21B 43/088 166/227
2007/0246225 A1 10/2007 Hailey et al.
2008/0041577 A1* 2/2008 Baaijens ..... E21B 43/10 166/227
2009/0120647 A1 5/2009 Turick et al.
2010/0051262 A1 3/2010 Dusterhoft et al.
2010/0051271 A1 3/2010 Gano et al.
2010/0252254 A1 10/2010 Nutley et al.
2013/0000890 A1 1/2013 Olenick et al.
2013/0206393 A1* 8/2013 Kuo ..... E21B 43/08 166/227
2014/0360613 A1 12/2014 Abshire et al.
2015/0375144 A1* 12/2015 Greci ..... B01D 29/111 29/896.61
2018/0328151 A1 11/2018 Wakefield et al.

OTHER PUBLICATIONS

International Search Report and Written Opinion for International Application No. PCT/US2018/026440; International Filing Date Apr. 6, 2018; Report dated Jul. 10, 2018 (pp. 1-12).

* cited by examiner

*Primary Examiner* — George S Gray
(74) *Attorney, Agent, or Firm* — CANTOR COLBURN LLP

(57) ABSTRACT

A tubular for reservoir fines control includes a body having an outer surface and an inner surface defining a flow path. A plurality of openings is formed in the body connecting the outer surface and the flow path. A pre-formed member including a material mesh is overlaid onto the outer surface. The material mesh is formed from a material swellable upon exposure to a selected fluid. The material mesh has a selected porosity allowing methane to pass into the flow path while preventing passage of fines.

5 Claims, 9 Drawing Sheets

MATERIAL MESH FOR SCREENING FINES

CROSS-REFERENCE TO RELATED APPLICATIONS

This application is a divisional of U.S. application Ser. No. 15/795,708 filed Oct. 27, 2017, which claims the benefit of provisional U.S. Application Ser. No. 62/504,676 filed May 11, 2017, the disclosure of each are incorporated by reference herein in their entirety.

BACKGROUND

Resource extraction techniques typically include forming a borehole and introducing a system of tubulars to guide a resource, such as oil or gas uphole to be captured and processed. Often time, methane gas may be found in a coalbed. Coalbed methane wells typically include numerous thin layers of clay or interburden between coal seams. During extraction, water is pulled from the coal seams allowing gas to escape. However, water flow over reactive clay interburden produces particulate such as fines that may enter into a downhole pump. In some cases, there are so many layers of interburden, zonal isolation is not practical. That is, isolating layers of interburden may block off productive portion of the coal seams leaving the gas trapped in the formation.

SUMMARY

Disclosed is a tubular for reservoir fines control including a body having an outer surface and an inner surface defining a flow path. A plurality of openings is formed in the body connecting the outer surface and the flow path. A pre-formed member including a material mesh is overlaid onto the outer surface. The material mesh is formed from a material swellable upon exposure to a selected fluid. The material mesh has a selected porosity allowing methane to pass into the flow path while preventing passage of fines.

Also discloses is a method of forming a permeable cover on a perforated tubular including positioning a pre-formed member having a material mesh permeable to a downhole gas on an outer surface of the perforated tubular. The material mesh is formed from a material swellable upon exposure to a selected fluid.

BRIEF DESCRIPTION OF THE DRAWINGS

Referring now to the drawings wherein like elements are numbered alike in the several Figures.

DETAILED DESCRIPTION

Figure 1:
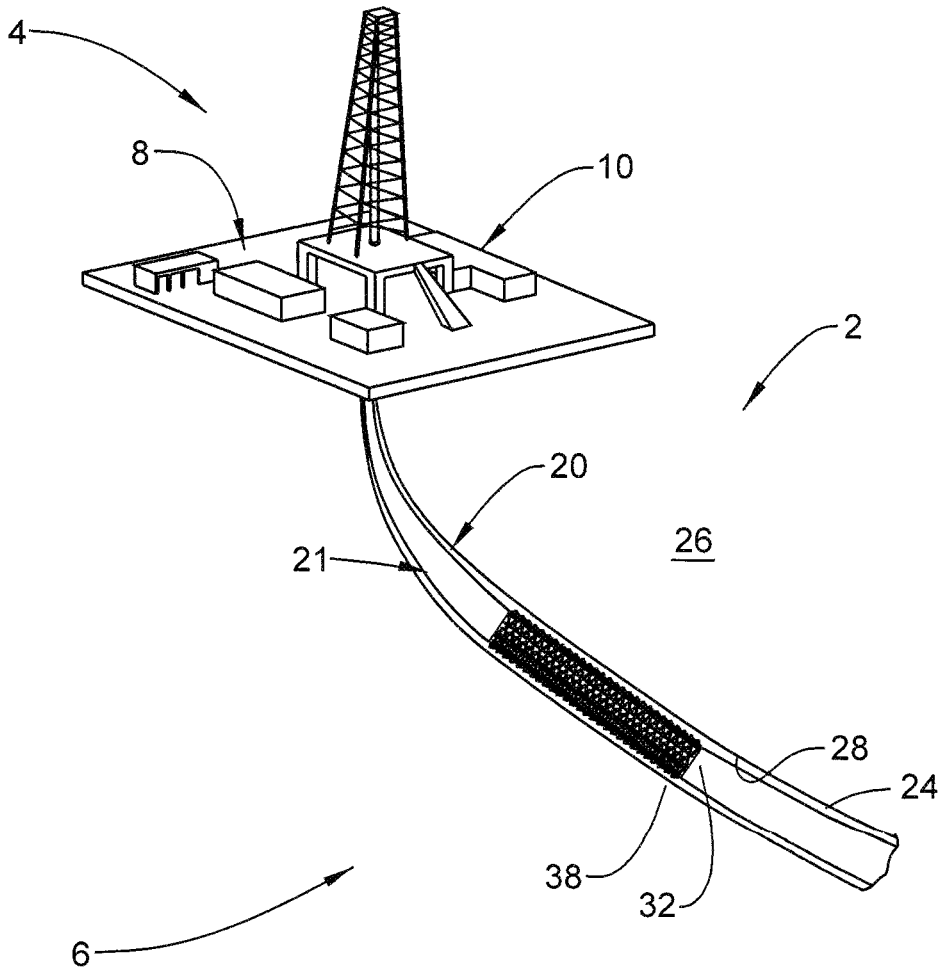
FIG. 1 depicts a resource recovery and exploration system including a material mesh for providing borehole support and fines screening, in accordance with an exemplary embodiment.

A resource exploration and recovery system, in accordance with an exemplary embodiment, is indicated generally at 2, in FIG. 1. Resource exploration and recovery system 2 may include a surface system 4 operatively connected to a downhole portion 6. Surface system 4 may include pumps 8 that aid in completion and/or extraction processes. Surface system 4 may also include a fluid storage member 10. Fluid storage member 10 may contain a gravel pack fluid or slurry (not shown), water, or other fluid which may be utilized in drilling and/or extraction operations.

Downhole portion 6 may include a downhole string 20 formed from a plurality of tubulars, one of which is indicated at 21 that is extended into a wellbore 24 formed in formation 26. Wellbore 24 includes an annular wall 28 that may be defined by formation 26. It is to be understood that annular wall 28 may also be defined by a casing. One of tubulars 21 may be define a perforated tubular 32 covered by a material mesh 38.

Figure 2:
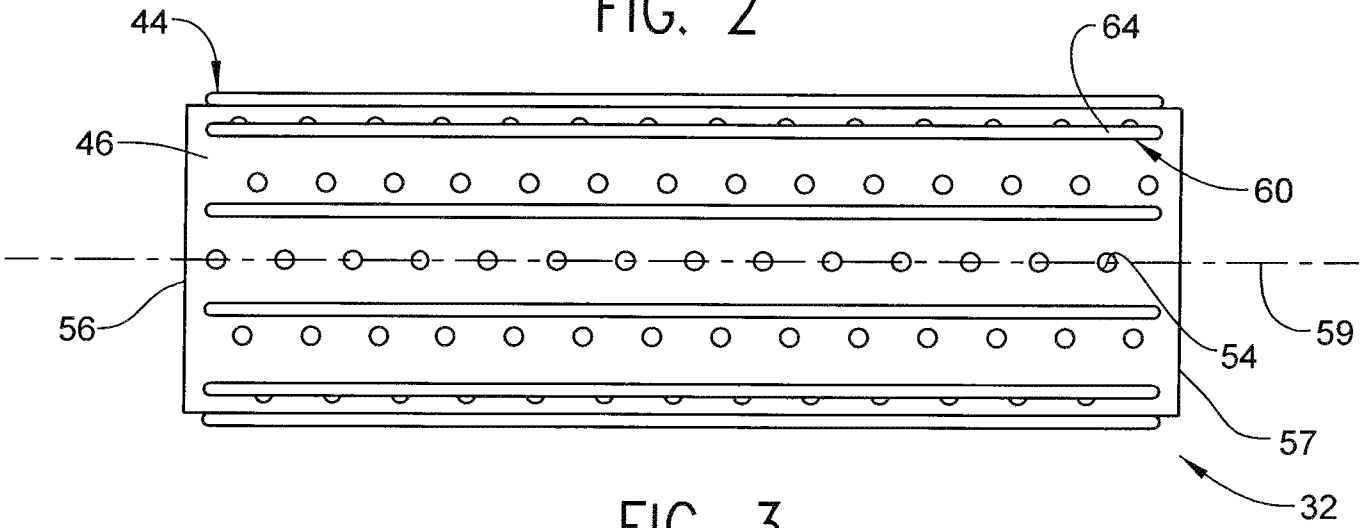
FIG. 2 depicts a perforated tubular having a first material mesh layer of the material mesh, in accordance with an exemplary embodiment.
Figure 5:
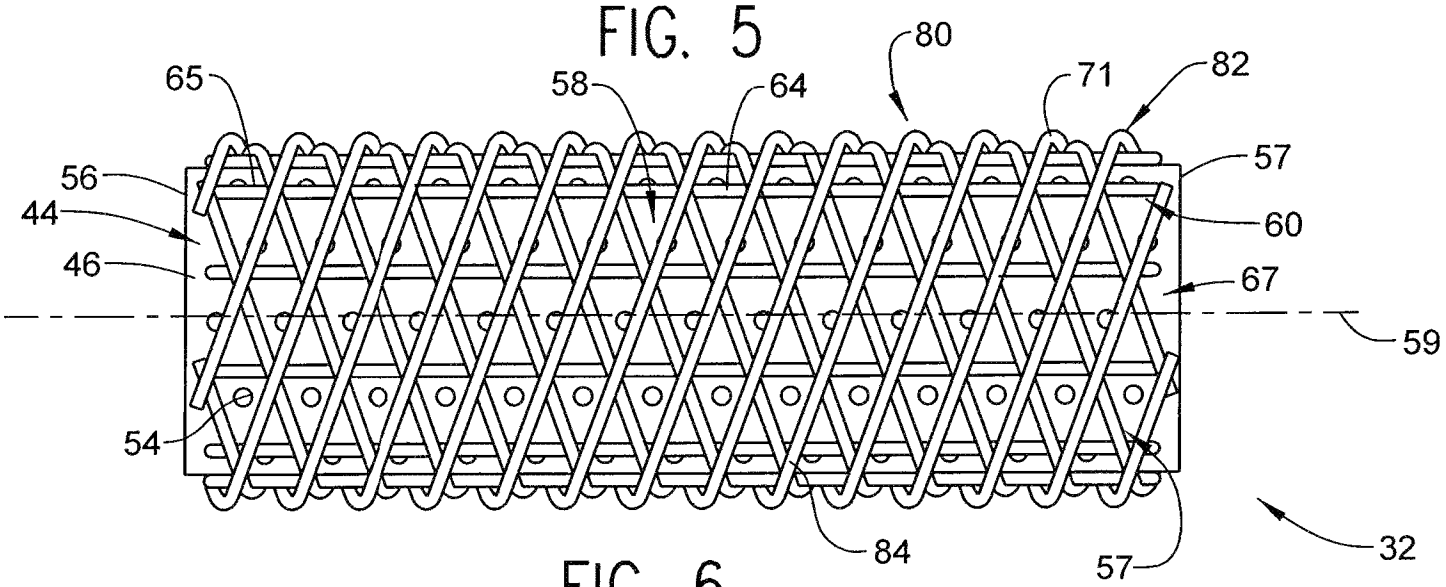
FIG. 5 depicts the perforated tubular of FIG. 3 having a third material mesh layer of the material mesh, in accordance with an exemplary embodiment.

In accordance with an exemplary aspect depicted in FIG. 2, perforated tubular 32 includes a body 44 having an outer surface 46, and an inner surface 48 (FIG. 5) that defines a flow path 50 (FIG. 5). Perforated tubular 32 includes a plurality of openings, one of which is shown at 54, that extend through outer surface 46 and inner surface 48 such that when deployed downhole, flow path 50 may be fluidically connected with wellbore 24. Perforated tubular 32 includes a first end 56, a second end 57, and an intermediate portion 58 defining a longitudinal axis 59 extending therebetween.

Figure 3:
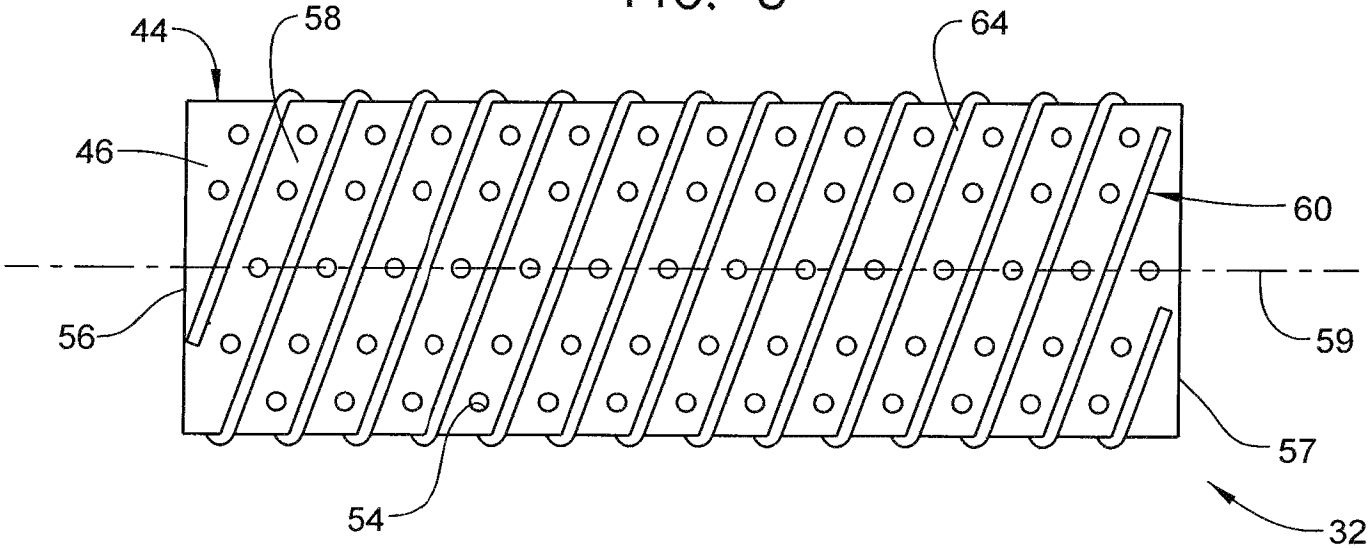
FIG. 3 depicts the first material mesh layer of the material mesh, in accordance with another aspect of an exemplary embodiment.

In accordance with an aspect of an exemplary embodiment, material mesh 38 may include a first material mesh layer 60 applied to outer surface 46. First material mesh layer 60 may include a plurality of discrete elements or cords 64 that extend axially along longitudinal axis 59 of perforated tubular 32. It should however be understood that cords 64 may extend at an angle relative to longitudinal axis 59 or may wrap around outer surface 46 as shown in FIG. 3. Cords 64 may be formed from a first material 65 that is swellable upon being exposed to a selected fluid. In accordance with an exemplary embodiment, the selected fluid may be a downhole fluid such as oil, water, or combinations thereof. In accordance with another exemplary aspect, the selected fluid may be a fluid introduced from surface system 4.

Figure 4:
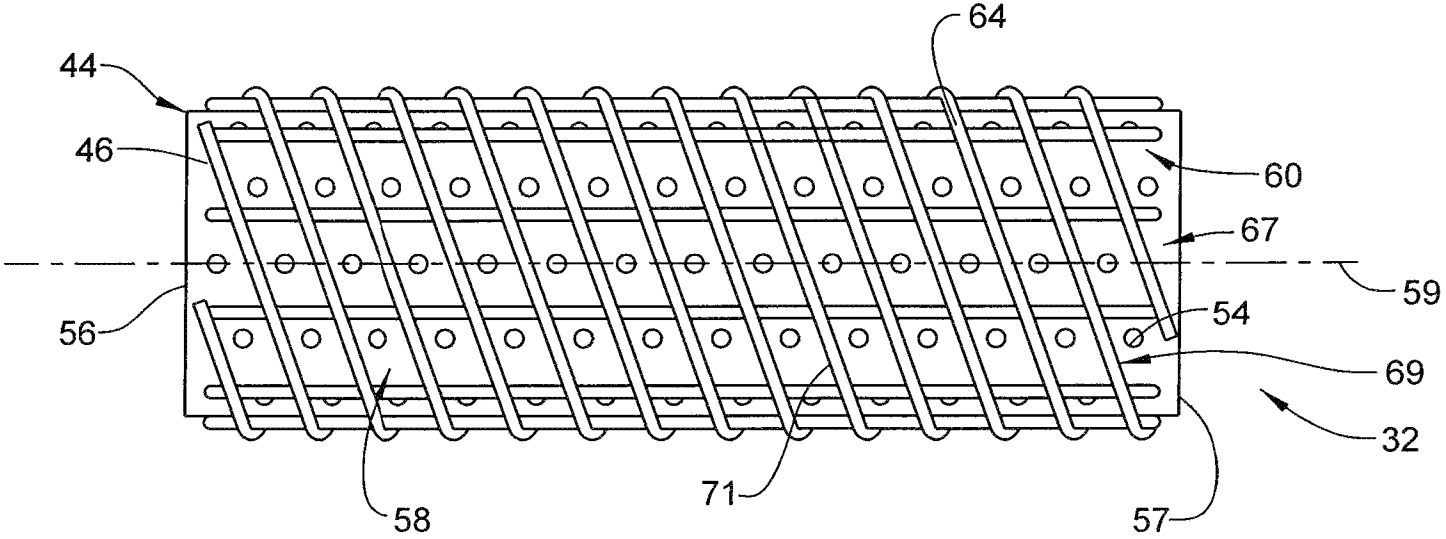
FIG. 4 depicts the perforated tubular of FIG. 2 having a second material mesh layer of the material mesh, in accordance with an exemplary embodiment.

In further accordance with an exemplary aspect, material mesh 38 may include a second material mesh layer 67 such as shown in FIG. 4. Second material mesh layer 67 may be formed from a cord member 69 formed from a second material 71. Second material 71 is swellable upon being exposed to a selected fluid. Further, second material 71 may be similar to first material 65 or may be distinct therefrom. For example, first material 65 may be swellable upon being exposed to water and second material 71 may be swellable upon being exposed to oil or vice versa. In accordance with another exemplary aspect, the selected fluid may be a fluid introduced from surface system 4. Second material mesh layer 67 may be overlaid onto first material mesh layer 60 in a variety of patterns. As shown in FIG. 3, second material mesh layer 67 may be spirally wrapped about first material mesh layer 60 with a selected spacing between adjacent wraps (not separately labeled).

Figure 6:
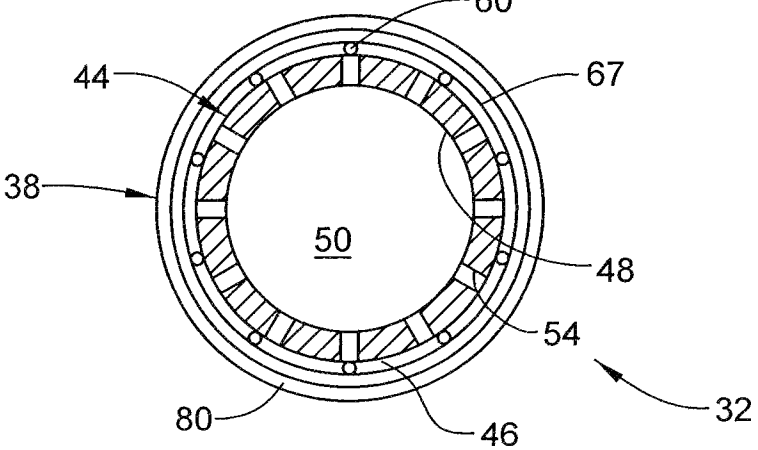
FIG. 6 depicts a cross-sectional view of the perforated tubular of FIG. 5.

In still further accordance with an exemplary aspect, material mesh 38 may include a third material mesh layer 80 as shown in FIGS. 5 and 6. Third material mesh layer 80 may be formed from a cord element 82 formed from a third material 84. Third material 84 is swellable upon being exposed to a selected fluid. Further, third material 84 may be similar to first material 65 and second material 71 or may be distinct therefrom. For example, third material 84 may be swellable upon being exposed to water and/or oil.

In accordance with another exemplary aspect, third material 84 may be swellable upon being exposed to a selected fluid that is introduced from surface system 4. Third material mesh layer 80 may be overlaid onto second material mesh layer 67 in a variety of patterns. As shown in FIG. 5, third material mesh layer 80 may be spirally wrapped about second material mesh layer 67 with a selected spacing between adjacent wraps (not separately labeled). Further, a wrap angle (not separately labeled) of third material mesh layer 80 may be opposite to a wrap angle (also not separately labeled) for second material mesh layer 67. As shown in FIG. 6, material mesh 38 may take the form of a number of layers overlaid onto each other.

Figure 7:
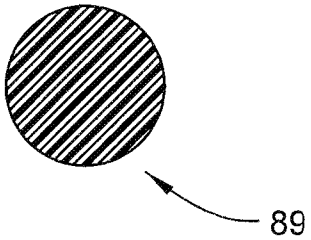
FIG. 7 depicts an exemplary cross-sectional profile of a cord forming one or more of the first, second, and third material mesh layers, in accordance with an exemplary aspect.
Figure 8:
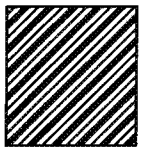
FIG. 8 depicts an exemplary cross-sectional profile of a cord forming one or more of the first, second, and third material mesh layers, in accordance with an exemplary aspect.
Figure 9:
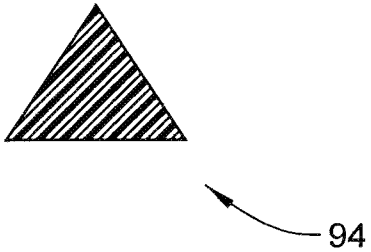
FIG. 9 depicts an exemplary cross-sectional profile of a cord forming one or more of the first, second, and third material mesh layers, in accordance with an exemplary aspect.
Figure 10:
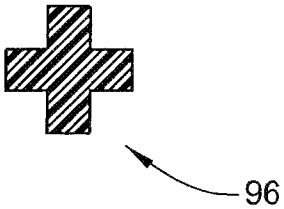
FIG. 10 depicts an exemplary cross-sectional profile of a cord forming one or more of the first, second, and third material mesh layers, in accordance with an exemplary aspect.
Figure 11:
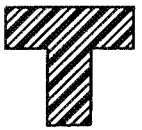
FIG. 11 depicts an exemplary cross-sectional profile of a cord forming one or more of the first, second, and third material mesh layers, in accordance with an exemplary aspect.
Figure 12:
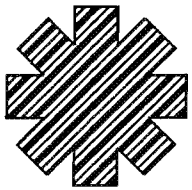
FIG. 12 depicts an exemplary cross-sectional profile of a cord forming one or more of the first, second, and third material mesh layers, in accordance with an exemplary aspect.

It should be appreciated that each of cord 64, cord member 69, and cord element 82 may include a selected cross-section shape. The cross-sectional shape may be similar or may vary depending upon desired screening requirements. For example, one or more of cord 64, cord member 69, and cord element 82 may include a generally circular cross-section such as shown at 89 in FIG. 7, a generally rectangular cross-section 92 such as shown in FIG. 8, a generally triangular cross-section 94 such as shown in FIG. 9, a generally cross-shaped cross-section 96 such as shown in FIG. 10, a generally t-shaped cross-section 98 such as shown in FIG. 11, and/or a generally multi-segmented cross-section 100 such as shown in FIG. 12.

Figure 13:
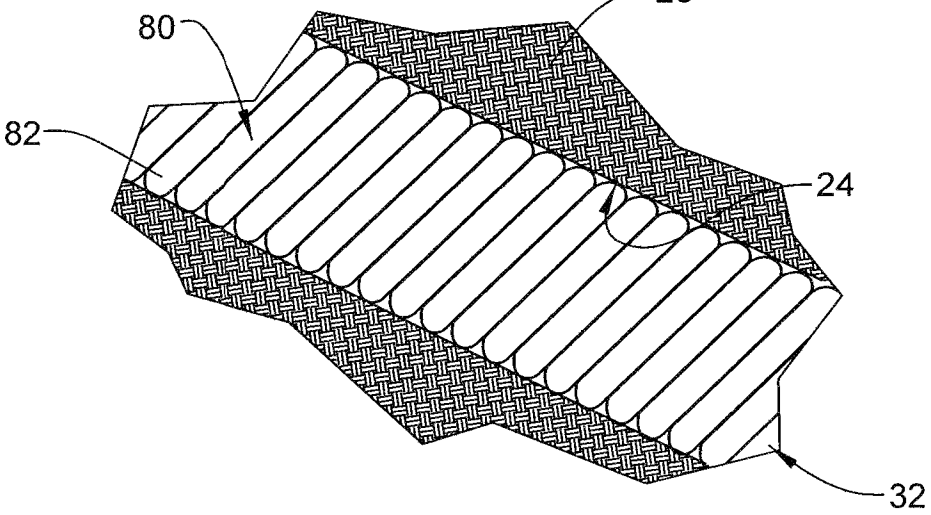
FIG. 13 depicts the material mesh after being exposed to a selected fluid, in accordance with an exemplary aspect.

In accordance with an exemplary embodiment, after a selected time period, which can vary, upon being exposed to the selected fluid, material mesh 38 will expand so as to define a lager outer diameter that abuts annular wall 28 of wellbore 24 and establish a desired permeability or porosity to screen out fines that may be present in wellbore fluid passing into perforated tubular 32 via openings 54 such as shown in FIG. 13.

Figure 14:
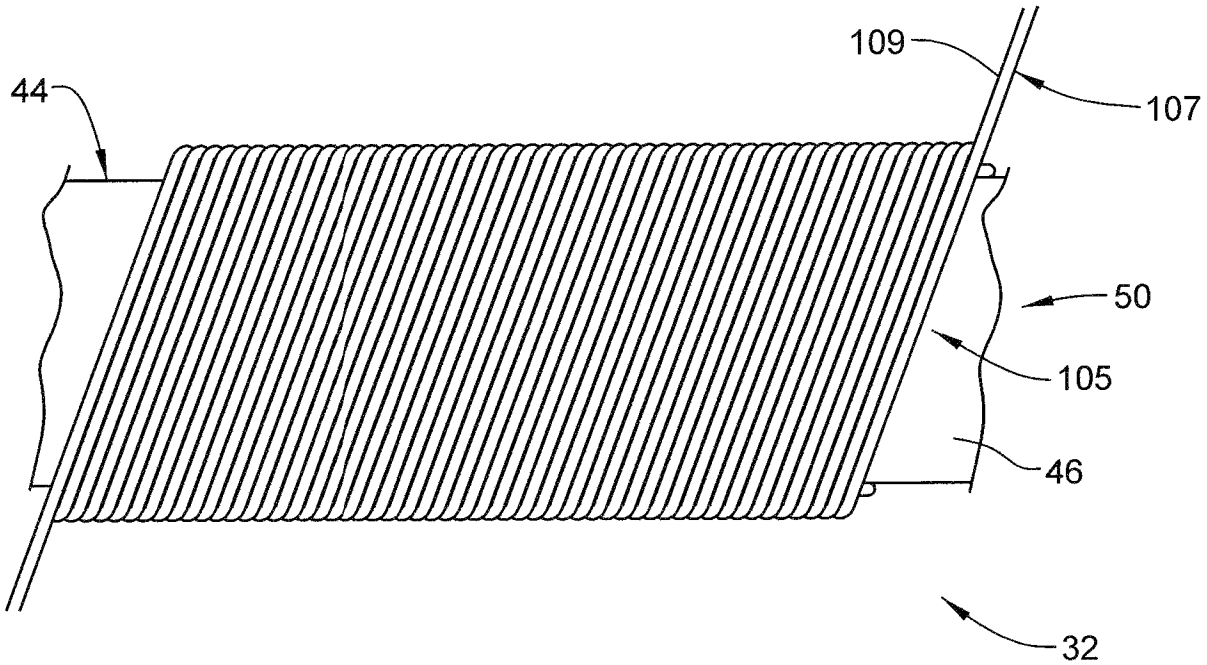
FIG. 14 depicts a material mesh formed from a continuous cord, in accordance with an exemplary embodiment.

Reference will now follow to FIG. 14, wherein like reference numeral represent corresponding parts in the respective views, in describing a material mesh 105 in accordance with another exemplary aspect. Material mesh 105 may include a continuous cord 107 formed from a material 109. Continuous cord 107 may be applied in a single layer or in multiple layers. Continuous cord 107 may include a constant cross-sectional dimension or a cross-sectional dimension that varies. Continuous cord 107 may be applied to perforated tubular 32 at surface system 4 or at an off-site location.

Further, continuous cord 107 may be extruded at surface system 4 such that diameters, shapes and materials may vary according to downhole conditions. In this manner, operators may adjust to downhole conditions on the fly without delays associated with fabricating, transporting, and installing pre-formed mesh. Further, material selection may vary such that a portion of material mesh 105 is swellable upon being exposed to a first fluid and other portions of material mesh 105 are swellable upon being exposed to a second fluid that is distinct from the first fluid.

Figure 15:
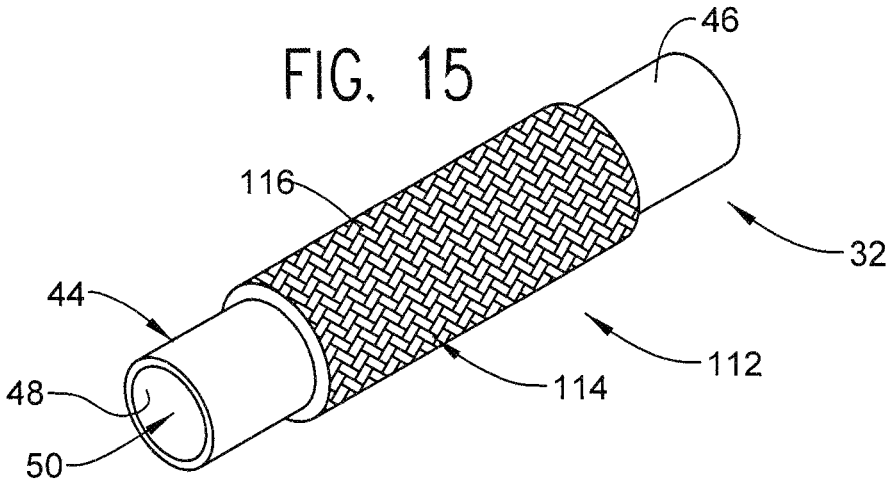
FIG. 15 depicts a material mesh as a pre-fabricated woven sleeve, in accordance with an exemplary embodiment.
Figure 16:
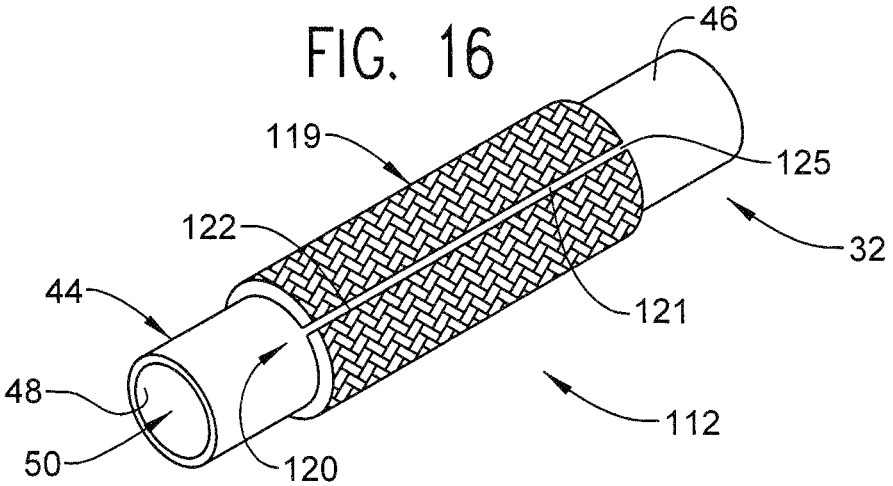
FIG. 16 depicts the material mesh as a pre-fabricated woven mat, in accordance with an exemplary embodiment.
Figure 17:
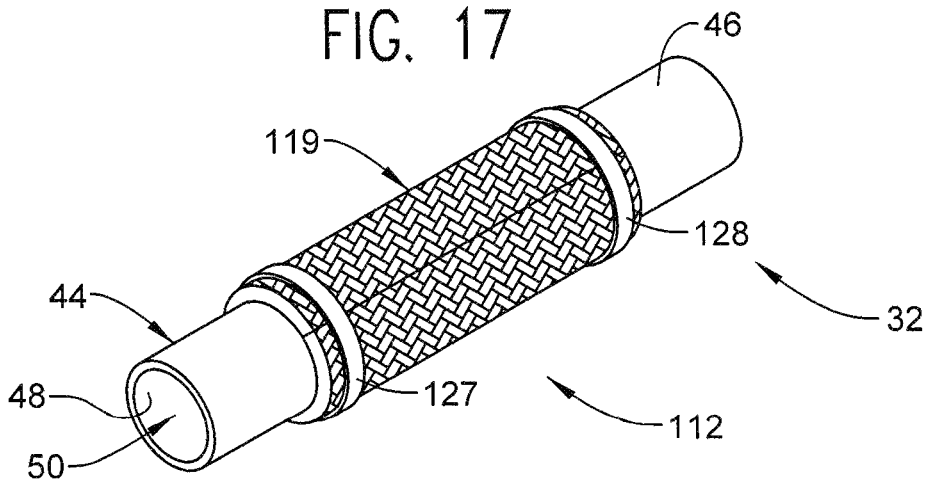
FIG. 17 depicts the pre-fabricated woven mat, in accordance with another aspect of an exemplary embodiment.
Figure 18:
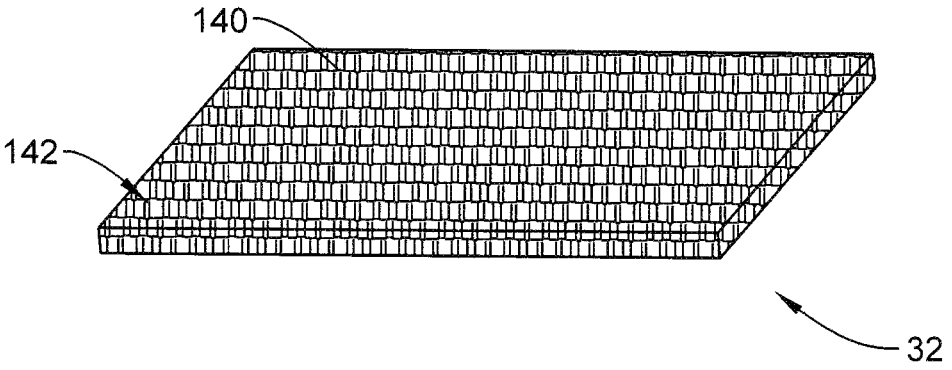
FIG. 18 depicts the material mesh as a pre-fabricated mat formed from a plurality of particles joined by a binder material, in accordance with another aspect of an exemplary embodiment.
Figure 19:
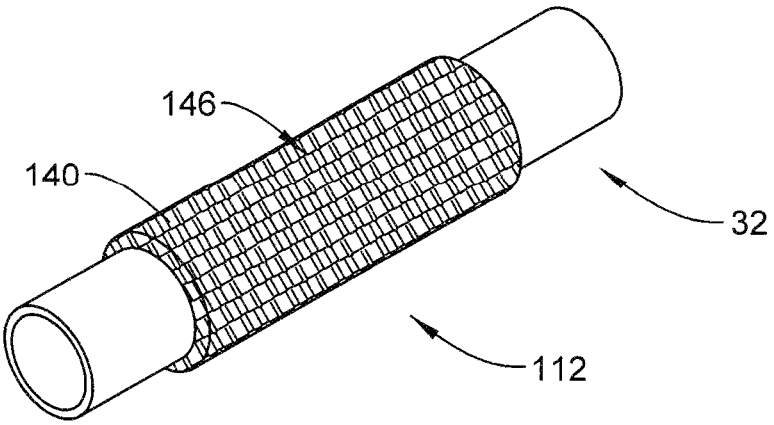
FIG. 19 depicts the material mesh as a pre-fabricated sleeve formed from a plurality of particles joined by a binder material, in accordance with yet another aspect of an exemplary embodiment.

Reference will now follow to FIG. 15, wherein like reference numeral represent corresponding parts in the respective views, in describing a material mesh 112 in accordance with another aspect of an exemplary embodiment. Material mesh 112 may be pre-formed from a material weave or interlaced cord 114 into a material sleeve 116. Material sleeve 116 may have a continuous outer surface (not separately labeled) as shown in FIG. 15 or may take the form of a pre-fabricated woven mat 119 having a discontinuity, such as shown at 120 in FIGS. 16 and 17. Discontinuity 120 may define a first end 121 and a second end 122. First end 121 may be bonded to second end 122 with an adhesive 125 or, as shown in FIG. 16, woven mat 119 may be secured to perforated tubular 32 with one or more clamps 127, 128. It is to be understood that material mesh 112 may be formed from a plurality of discrete particles such as shown at 140 in FIG. 18 joined by a binder material (not separately labeled) to form a mat 142. Alternatively, particles 140 may be formed into a sleeve 146 such as shown in FIG. 19. The discrete particles are swellable upon being exposed to one or more selected fluids.

At this point, it should be understood that exemplary embodiments describe a material mesh that may take the form of one or more layers of cord applied to an outer surface of a tubular, or a woven mesh. The material mesh may be formed from one or more materials that are swellable when exposed to a selected fluid to establish a selected porosity or permeability. Upon swelling, material mesh provides support to internal surfaces of a well bore to enhance fluid production by, for example, providing reservoir fines control. At the same time, material mesh defines a fluid permeable cover which screens out fines that may be present in the fluid, such as a downhole gas, passing uphole.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

Set forth below are some embodiments of the foregoing disclosure:

Embodiment 1. A tubular for reservoir fines control comprising: a body including an outer surface and an inner surface defining a flow path, a plurality of openings is formed in the body connecting the outer surface and the flow path; and a pre-formed member including a material mesh overlaid onto the outer surface, the material mesh being formed from a material swellable upon exposure to a selected fluid, the material mesh having a selected porosity allowing methane to pass into the flow path while preventing passage of fines.

Embodiment 2. The tubular according to any prior embodiment, wherein a portion of the material mesh extends at an angle relative to a longitudinal axis of the body.

Embodiment 3. The tubular according to any prior embodiment, wherein the pre-formed member comprises a pre-formed sleeve.

Embodiment 4. The tubular according to any prior embodiment, wherein the pre-formed member comprises a weave.

Embodiment 5. The tubular according to any prior embodiment, wherein the pre-formed member comprises a mat having a first end and a second end.

Embodiment 6. The tubular according to any prior embodiment, wherein the mat is clamped to the outer surface.

Embodiment 7. The tubular according to any prior embodiment, wherein the mat is secured about the outer surface with the first end being bonded to the second end.

Embodiment 8. The tubular according to any prior embodiment, wherein the pre-formed member comprises a continuous cord.

Embodiment 9. The tubular according to any prior embodiment, wherein the continuous cord includes a first portion having a first dimension and a second portion having a second dimension that is distinct from the first dimension.

Embodiment 10. The tubular according to any prior embodiment, wherein the pre-formed member is formed from a plurality of discrete particles suspended in a binder material.

Embodiment 11. A method of forming a permeable cover on a perforated tubular comprising: positioning a pre-formed member including a material mesh permeable to a downhole gas on an outer surface of the perforated tubular, the material mesh being formed from a material swellable upon exposure to a selected fluid.

Embodiment 12. The method according to any prior embodiment, wherein positioning the pre-formed member includes arranging a woven material on the outer surface of the tubular.

Embodiment 13. The method according to any prior embodiment, wherein positioning the pre-formed me member includes securing a pre-fabricated mat to the outer surface of the tubular.

Embodiment 14. The method according to any prior embodiment, wherein securing the pre-fabricated mat included adhesively bonding the pre-fabricated mat about the tubular.

Embodiment 15. The method according to any prior embodiment, wherein securing the pre-fabricated mat includes wrapping the pre-fabricated mat about the outer surface.

Embodiment 16. The method according to any prior embodiment, further comprising: bonding a first end of the pre-fabricated mat to a second end of the pre-fabricated mat.

Embodiment 17. The method according to any prior embodiment, wherein positioning the pre-formed member includes wrapping a continuous chord about the outer surface.

Embodiment 18. The method according to any prior embodiment, wherein wrapping the continuous chord includes wrapping a first portion of the continuous chord having a first dimension and a second portion of the continuous chord having a second dimension that is distinct from the first dimension about the outer surface.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubular for reservoir fines control comprising:

a body including an outer surface and an inner surface defining a flow path, a plurality of openings is formed in the body connecting the outer surface and the flow path; and a pre-formed member overlaid onto the outer surface, the pre-formed member including a material mesh having an outer surface portion and an inner surface portion defining a thickness of the pre-formed screen member, the material mesh being formed from a material that is swellable upon exposure to a selected fluid, the material mesh having a selected porosity allowing methane to pass into the flow path, wherein the inner surface portion is in contact with the outer surface of the body, and upon exposure to the selected fluid the thickness of the material mesh increases to prevent passage of fines into the flow path and provide support to wellbore surfaces.

2. The tubular according to claim 1, wherein a portion of the material mesh extends at an angle relative to a longitudinal axis of the body.

3. The tubular according to claim 1, wherein the pre-formed member comprises a pre-formed sleeve.

4. The tubular according to claim 1, wherein the pre-formed member is formed from a plurality of discrete particles suspended in a binder material.

5. A method of forming a permeable cover on a perforated tubular having an outer surface comprising:

positioning a pre-formed member including a material mesh having an outer surface portion and an inner surface portion defining a thickness of the pre-formed member, the pre-formed member being permeable to a downhole gas with the inner surface portion being in contact with the outer surface of the perforated tubular, the material mesh being formed from a material that is swellable upon exposure to a selected fluid, wherein upon exposure to the selected fluid the thickness of the material mesh increases to prevent passage of fines into the flow path and provide support to wellbore surfaces.

* * * * *